United States Patent [19]

Kuckhermann

[11] 4,301,842

[45] Nov. 24, 1981

[54] FILLING STATION FOR PLEAT-SIDED BAGS

[75] Inventor: Gustav Kuckhermann, Achern, Fed. Rep. of Germany

[73] Assignee: Icoma Packtechnik GmbH, Achern, Fed. Rep. of Germany

[21] Appl. No.: 96,346

[22] Filed: Nov. 21, 1979

[30] Foreign Application Priority Data

Dec. 1, 1978 [DE] Fed. Rep. of Germany ..... 2852022

[51] Int. Cl.[3] ..... B65B 1/04

[52] U.S. Cl. ..... 141/114; 141/317; 53/386

[58] Field of Search ..... 141/10, 67, 68, 114, 141/311–317, 136, 140, 148, 149, 165, 172, 253, 257, 262, 263, 269, 270, 275–278, 281, 94, 156, 157; 53/468, 469, 386

[56] References Cited

U.S. PATENT DOCUMENTS 3,750,721 8/1973 Hudson ..... 141/317

*Primary Examiner*—Houston S. Bell, Jr.
*Attorney, Agent, or Firm*—Vande Sande & Priddy Pollock

[57] ABSTRACT

A filling station for filling pleat-sided bags transports such bags in flat form to a filling position. A plurality of spreading members are disposed adjacent the front and rear faces of the bag, and have claws thereon which engage the opposing interior edges of the bag adjacent its openable mouth. The spreading members adjacent each given side of the bag are moved away from one another in a direction substantially parallel to the planes of the front and rear bag faces, and the spreading members on opposite sides of the bag are moved away from one another in directions transverse to said planes thereby to unfold the pleated side faces of the bag and open the mouth of the bag. A filling funnel disposed outside of the bag is moved into the opened mouth of the bag, and bars disposed adjacent the exterior of the several faces of the bag are moved into engagement with those faces to clamp the faces of the bag to the filling funnel during the filling of the bag.

13 Claims, 19 Drawing Figures

34

II b
8
17,14,16
8
7
5
9
4
22
49
23
28
30
31
2
3
29
51
52

10
13

24
20
21
27
16
19
6
5
15
4
14
17
18
7
25
9
49
26
11
12

FILLING STATION FOR PLEAT-SIDED BAGS

BACKGROUND OF THE INVENTION

The present invention relates to a filling station or apparatus adapted to fill pleat-sided bags delivered thereto in flat form for transport to a filling position whereat the bag may be filled by a filling funnel. The station comprises spreading members which are adapted to engage the openable end or mouth of the bag to open the mouth so that it can receive the filling funnel, and the apparatus further includes clamping means for holding the opened bag in engagement with the filling funnel during the filling operation.

Devices of the general type described above have been suggested heretofore. However in these known devices, the pleats on the pleated sides of the bag are customarily held pressed together, i.e., remain in their folded condition, during the filling of the bag. A substantially smaller cross-sectional area is thus provided, in these known devices, for filling the bag than would be presented if the pleated sides of the bag had been opened prior to commencement of the filling operation. This disadvantage becomes particularly serious when relatively small pleat-sided bags are to be filled, for in this type of situation the bags cannot in some cases be filled by known filling means inasmuch as the cross-sectional area provided by the opened mouth is too small when the pleated sides of the bag remain clamped together.

The primary purpose of the present invention is to provide an improved filling station of the type suggested heretofore, wherein a pleat-sided bag can be delivered in flat form to a filling position to be filled by means of a filling funnel, but wherein the filling station is so constructed that the pleated side faces of the bag are unfolded prior to commencement of a filling operation, thereby to provide an open mouth bag area which is considerably larger than the mouth area achieved in prior devices, and to permit the filling operation to be accomplished by use of a filling funnel which has a cross-sectional area that is substantially as large as the cross-sectional area of the bag with unfolded side pleats.

SUMMARY OF THE INVENTION

In accordance with the present invention, the filling station is provided with spreading members that are disposed on opposite sides of the bag, in facing relation to the unpleated front and rear faces of the bag, and which have claws movably mounted thereon to engage the opposing interior edges of the bag along the nonpleated faces of said bag adjacent its openable mouth when the said bag has been transported into a predetermined filling position in the filling station. Drive elements, preferably taking the form of either hydraulically or pneumatically operated elements, are adapted to move at least one claw on each side of the bag into clamping engagement with the bag edges at a generally central position on each such edge, are adapted to move others of the spreading members adjacent each side of the bag in directions parallel to the planes of the front and rear bag faces in sliding engagement with the interior edges of the bag until the claws on said other spreading members reach clamping positions generally adjacent the corners of the openable mouth of the bag, and are adapted further to move all of the spreading members on one side of the bag away from all of the spreading members on the other side of the bag along directions which are transverse to the planes of the front and rear faces of the bag thereby to cause at least a partial unfolding of the pleated side faces of the bag while the mouth of the bag is being opened.

By this arrangement, the cross-sectional area of the bag is enlarged to substantially its maximum cross-sectional area or, by a full unfolding of the pleated side faces of the bag, the cross-sectional area of the bag is opened to its maximum cross-sectional area. Thereafter a filling funnel, having a cross-sectional area which is substantially equal to the enlarged cross-sectional bag area achieved by the present invention, is inserted into the opened mouth of the bag to fill the bag. Clamping elements are positioned to engage both the nonpleated faces of the bag as well as the unfolded pleated side faces of the bag to clamp the bag between said elements and the inserted filling nozzle during the filling operation. In the embodiment of the invention wherein the pleated side faces are only partially opened, the clamping elements that cooperate with the pleated side faces of the bag are of generally V-shape to conform to the configuration of the partially unfolded pleated side faces of the bag, and the funnel is provided with a complementary cross-sectional shape in this same region of the apparatus. In another embodiment of the invention, wherein the bag is opened to its maximum extent prior to insertion of the filling funnel, so that the pleated side faces of the bag assume a substantially planar configuration, the clamping bars are of rectangular configuration and the cross-sectional shape of the filling funnel is straight-sided adjacent the side faces of the bag.

BRIEF DESCRIPTION OF THE DRAWINGS

The foregoing objects, advantages, construction and operation of the present invention will become more readily apparent from the following description and accompanying drawings wherein.

DESCRIPTION OF THE PREFERRED EMBODIMENTS

Figure 1A:
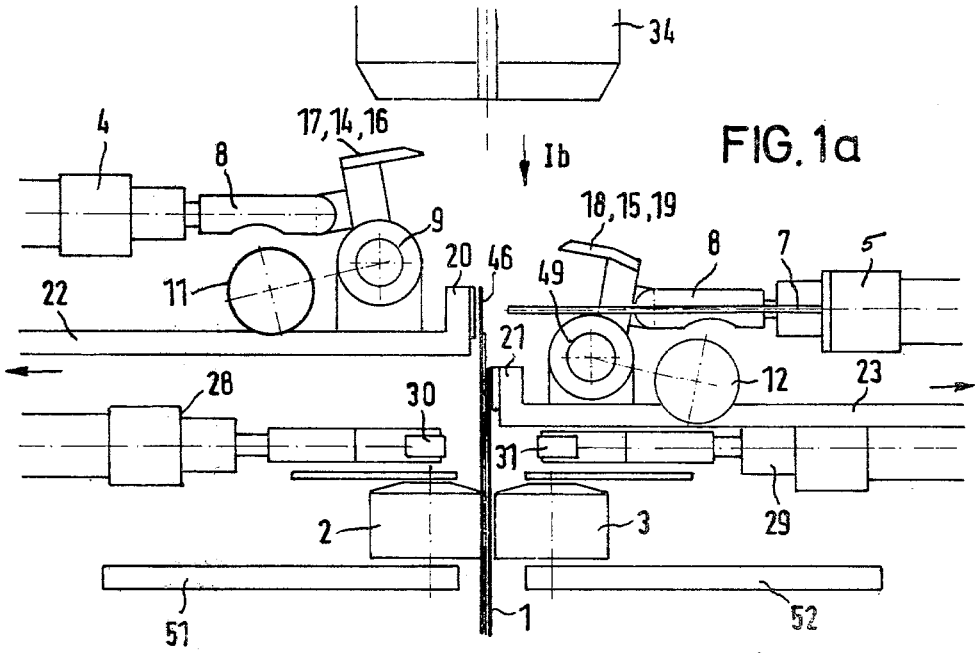
FIG. 1*a* is a diagrammatic side view of a filling station constructed in accordance with the present invention, showing a pleat-sided bag just delivered thereto and still in folded form, and the relative positioning of the parts of the filling station at this initial state of operation.
Figure 1B:
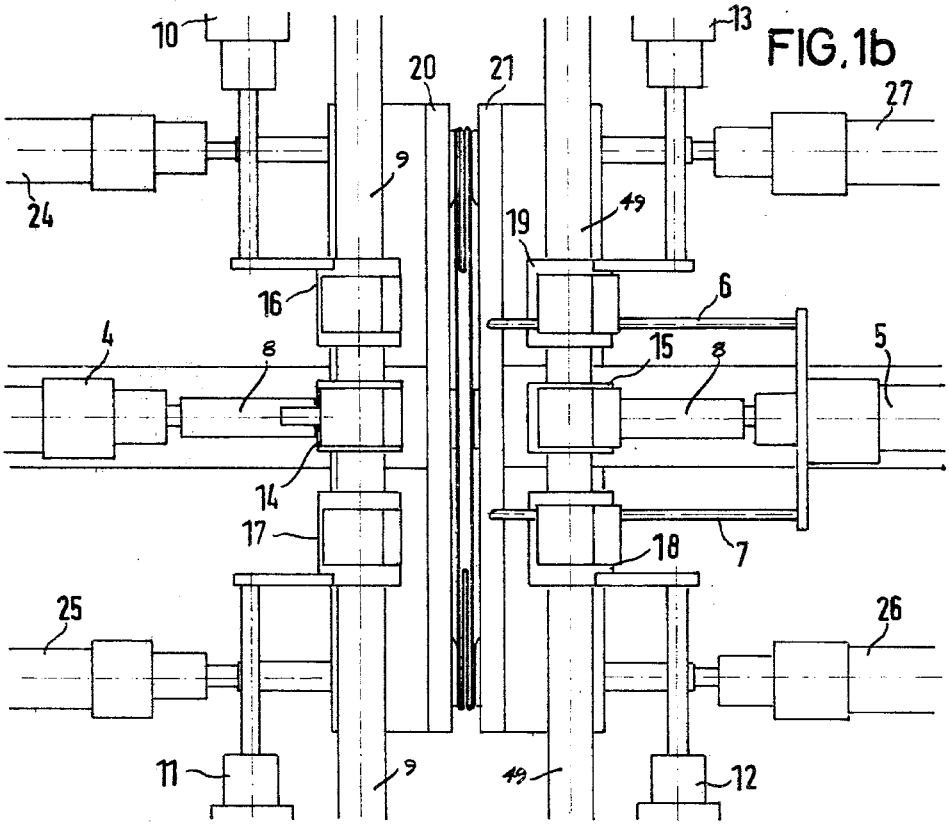
FIG. 1*b* is a plan view of the structure shown in FIG. 1*a* as viewed in the direction of arrow Ib in FIG. 1*a;*

Referring initially to FIGS. 1*a* and 1*b,* the filling station of the present invention comprises a pair of transport rollers 2, 3 which are operative to deliver a pleat-sided bag 1 in flat form to a filling position under a filling funnel 34. The pleat-sided bag 1 has a projecting sealing flap 46, comprising an extension of the unpleated rear face of the bag, which extends to a position above the right-hand edge or upper extremity of the unpleated front face of the bag. When the bag is properly located in its filling position, the projecting sealing flap 46 of the bag is positioned directly adjacent to and at the height of a clamping beam 20. A further clamping beam 21 is provided adjacent the other unpleated face of the bag, e.g., the front face of the bag, and is, as shown in FIG. 1*a,* located at a position which is displaced downwardly relative to clamping beam 20. The clamping beams 20 and 21 are mounted respectively on base plates 22 and 23 which can be moved, together with the members mounted thereon, in the directions depicted by arrows adjacent to the base plates 22 and 23, from the position shown in FIG. 1 to the outermost positions shown in FIG. 4 or 5 (depending upon which embodiment of the invention is being employed).

Figure 2A:
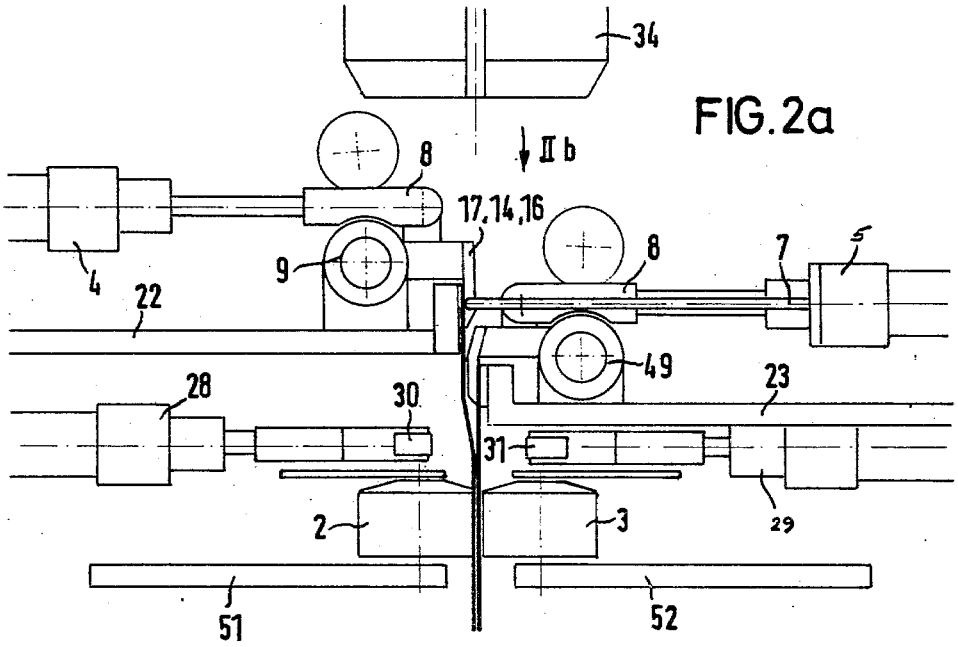
FIG. 2*a* is a side view of the filling station of FIG. 1*a*, at an immediately subsequent state of the operation with the claws on the spreading members positioned to engage the interior bag edges.

A plurality of spreading members, e.g., three on each side of the bag, are provided for selective engagement with the bag and for movement relative to one another to open the bag prior to the filling operation. As will best be seen by reference to FIG. 1*b,* three such spreading members are provided on the right-hand side of the bag (as viewed in FIG. 1*b*), and comprise a central member having a claw 15, which central member is flanked by two other spreading members having claws 18 and 19. A similar arrangement is provided on the other side of the bag, and consists of a central member having a claw 14, and two flanking members having claws 16 and 17. As will become apparent subsequently, the several claws are adapted to be moved from the disengaged position shown in FIG. 1*a* into the position shown in FIG. 2 et seq to engage the interior edges of the bag extending across the unpleated front and rear faces of the bag and adjacent to the openable mouth of the bag. The sequence of engagement, which will be described more fully hereinafter, is one wherein the central claws 14, 15 are moved to the position shown in FIG. 2*a* to clamp a substantially central portion of the bag edge adjacent its openable mouth between the claws 14, 15 and protruding clamping zones on clamping beams 20, 21 respectively. However the claws 16, 17, 18 and 19, although moved into a position similar to that of claws 14, 15, do not actually clamp the bag due to a recessed configuration which is provided in the clamping beams, and these outermost claws are, instead, moved away from one another relative to the central claws 14, 15 in directions generally parallel to the front and rear faces of the bag until the claws 16–19 come into sliding engagement with additional clamping zones on the clamping beams 20, 21 to produce clamping action adjacent the corners of the openable bag mouth at a time subsequent to the clamping engagement of the central claws 14, 15.

The transport rollers 2, 3 are carried by plates 51 and 52 upon which the base plates 22 and 23 are displaceably mounted, and they act to initially retain the pleat-sided bag in position until the two central claws 14 and 15 move into position to clamp the edges of the bag mouth against the cooperating protruding zones of clamping beams 20 and 21.

Figure 2B:
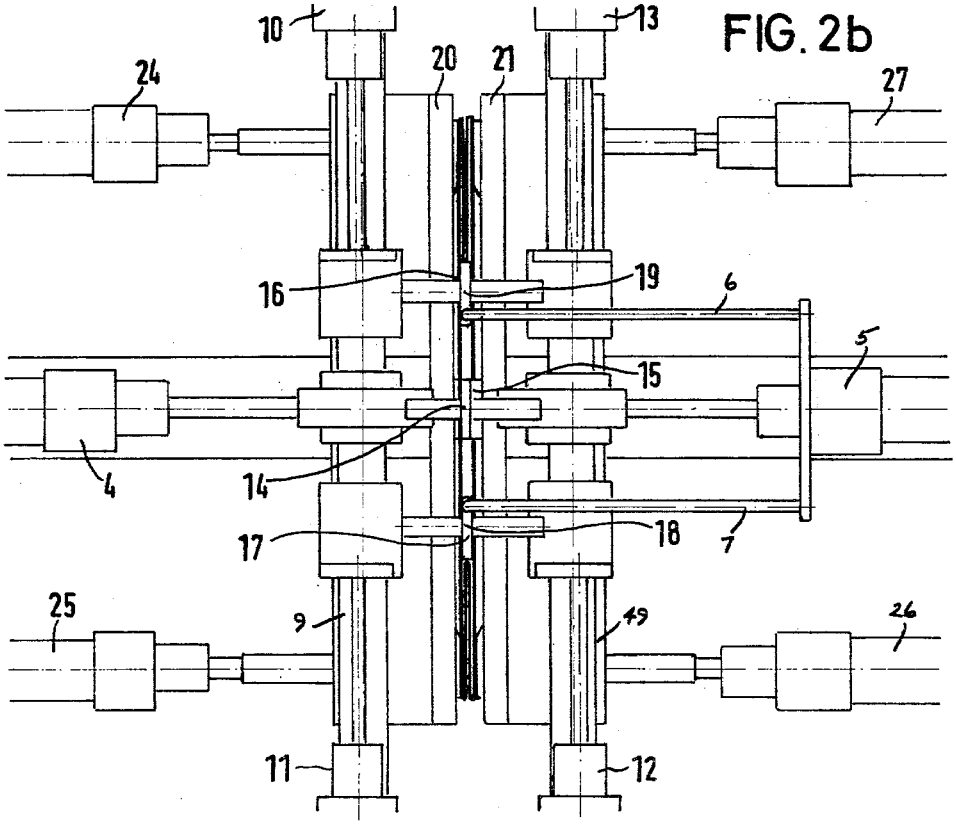
FIG. 2*b* is a plan view of FIG. 2*a* viewed in the direction of arrow II*b* in FIG. 2*a;*

Two driving cylinders 4, 5 are mounted on the base plates 22 and 23 on opposite sides of the bag respectively, and these cylinders 4, 5 are coupled to the central claws 14, 15 by means of a linkage 8 so that, upon operation of the cylinders 4, 5, the central claws 14 and 15 pivot from the position shown in FIG. 1*a* to the clamping position shown in FIG. 2. This angular motion of the central claws 14, 15 is transferred, moreover, to the outer claws 16–19 inasmuch as the said outer claws are mounted on ribbed shafts 9, 49 which rotate with rotation of the central claws 14, 15. As will be apparent, the ribbed shafts 9, 49 permit, moreover, movement of the claws 16 and 17 outwardly of the central claw 14, in a direction parallel to the direction of elongation of clamping beam 20, under the contol of pneumatic or hydraulic operators 10, 11, and ribbed shaft 49 permits similar outward movement of claws 18, 19 relative to central claw 15, in a direction parallel to the direction of elongation of clamping beam 21, under the control of operators 12, 13.

The base plates 22 and 23, and the plates 51 and 52, are displaceable in a direction transverse to the direction of travel of the pleat-sided bags, i.e., in a direction transverse to the planes of the unpleated front and rear faces of the bag, under the control of transverse driving cylinders 24, 25 on one side of the bag, and transverse driving cylinders 26, 27 on the other side of the bag. When the transverse cylinders 24–27 are operated, the clamping beams 20 and 21 are moved apart from one another, and are displaced respectively from the positions shown in FIGS. 1 and 2, to the successively more spaced positions shown in FIGS. 3, 4 and 5. This operation, effected by driving cylinders 24–27 in cooperation with the bag edge clamping actions achieved by claws 14–19, opens the bag by at least partially unfolding the pleated side faces of the bag, so that the bag can be filled by insertion of the filling funnel 34 into the opened mouth of the bag.

Two retaining members in the form of retaining fingers 6 and 7 are secured to the piston of driving cylinder 5 for movement therewith. Retaining fingers 6, 7, when moved forward by the driving cylinder 5, contact the sealing flap 46 of the folded bag 1 and press said sealing flap 46 against clamping beam 20 before the claws 14–19 are pivoted down for engagement with the bag edges adjacent its openable mouth. By this action of fingers 6, 7, the bag is opened slightly initially so that the claws 14–19 can each come to rest against the inside edge of the bag opening. In the forward position of the claws shown in FIG. 2, the central claws 14 and 15 immediately achieve a clamping position and hold the bag securely between the claws 14, 15 and the opposing clamping zones of clamping beams 20 and 21. However even though the claws 16–19 assume a position which corresponds to that of claws 14, 15 at this initial stage of the operation, the claws 16–19 do not at this time come into clamping engagement with the bag because of the configuration of the clamping beams 20 and 21.

Figure 8:
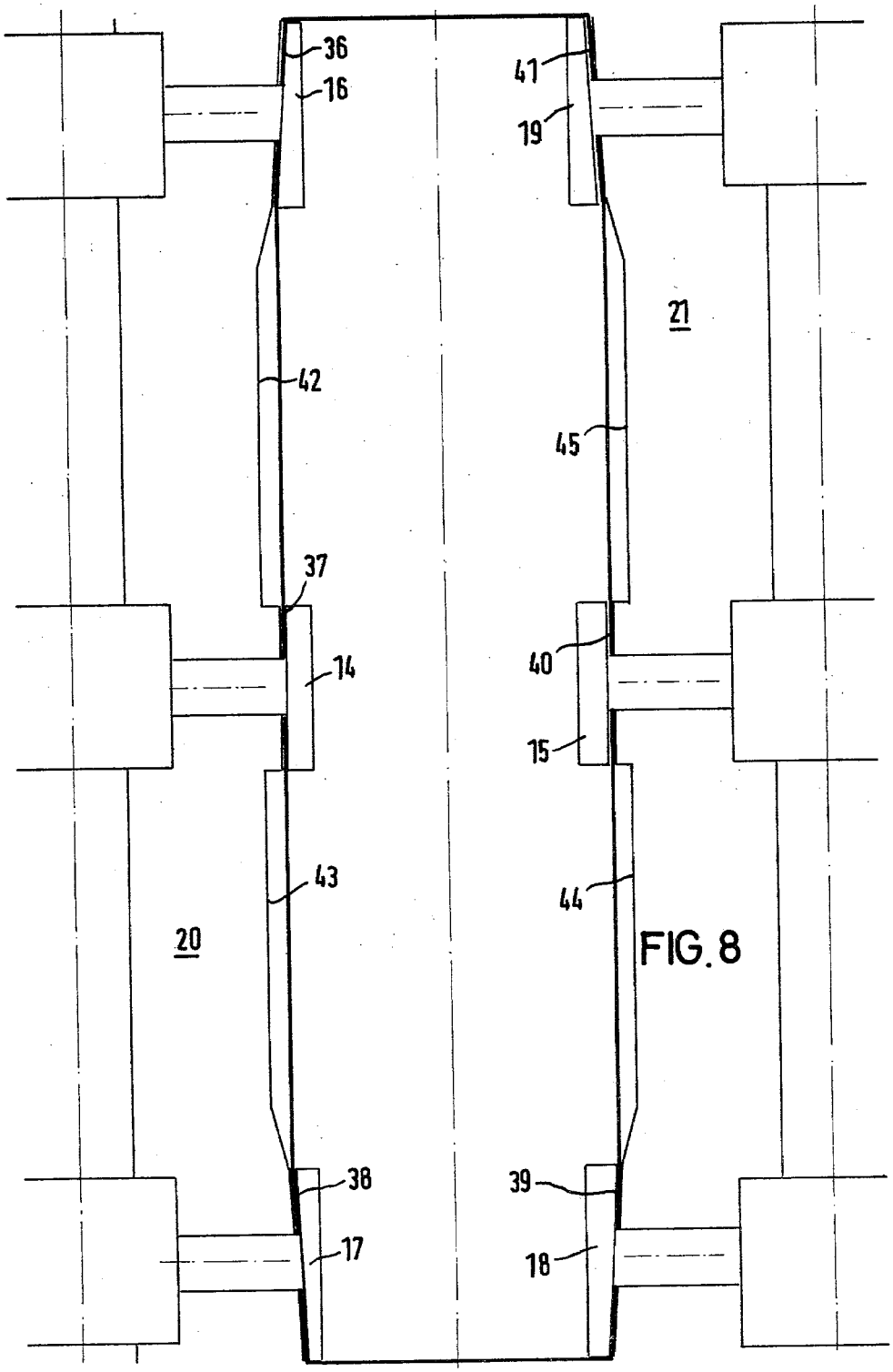
FIG. 8 is a diagrammatic view, in somewhat greater detail, of the clamping beam and claw arrangements employed in the filling station of FIGS. 1 through 5.

This latter aspect of the present invention will become more readily apparent by consideration of FIG. 8. It will be seen that the clamping beams 20 and 21 are so arranged that each provides three protruding clamping zones, i.e., for clamping beam 20, a central clamping zone 37 which is disposed generally parallel to the direction of elongation of the beam, and two end clamping zones 36, 38 which are angularly inclined, by an acute angle, to the direction of elongation of beam 20. Central clamping zone 37 is separated from end zones 36, 38 by a pair of elongated recesses 42, 43 respectively. Similarly, with respect to clamping beam 21, a central clamping zone 40 is provided which corresponds to central clamping zone 37, and angularly inclined end clamping zones 39, 41 are provided which correspond respectively to clamping zones 38, 36 on beam 20, the clamping zones 39 and 41 being separated from clamping zone 40 by elongated recesses 44, 45 respectively on beam 21. It will be further noted from FIG. 8 that the configurations of the several claws correspond to the configurations of the several clamping zones with which they are intended to cooperate, i.e., the clamping faces of claws 14, 15 are parallel to the center line of FIG. 8 for cooperation with the similar configuration of clamping zones 37, 40, whereas claws 16–19 have an acute angular configuration relative to the vertical longitudinal plane, with the apex of the acute angle being directed outwardly, for cooperation with the similar angularly inclined zones 36, 38, 39 and 41.

Figure 3A:
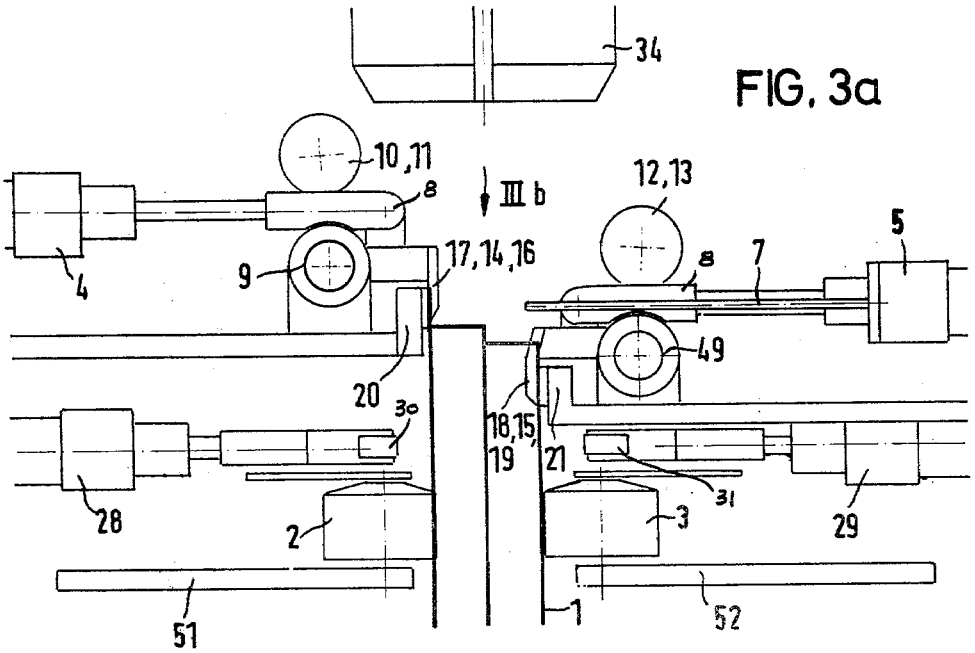
FIGS. 3*a* and 3*b* are further views of the structure, corresponding to the views previously described, but showing the relative positioning of the parts at a subsequent stage of the operation with the pleated side faces of the bag partially unfolded.
Figure 3B:
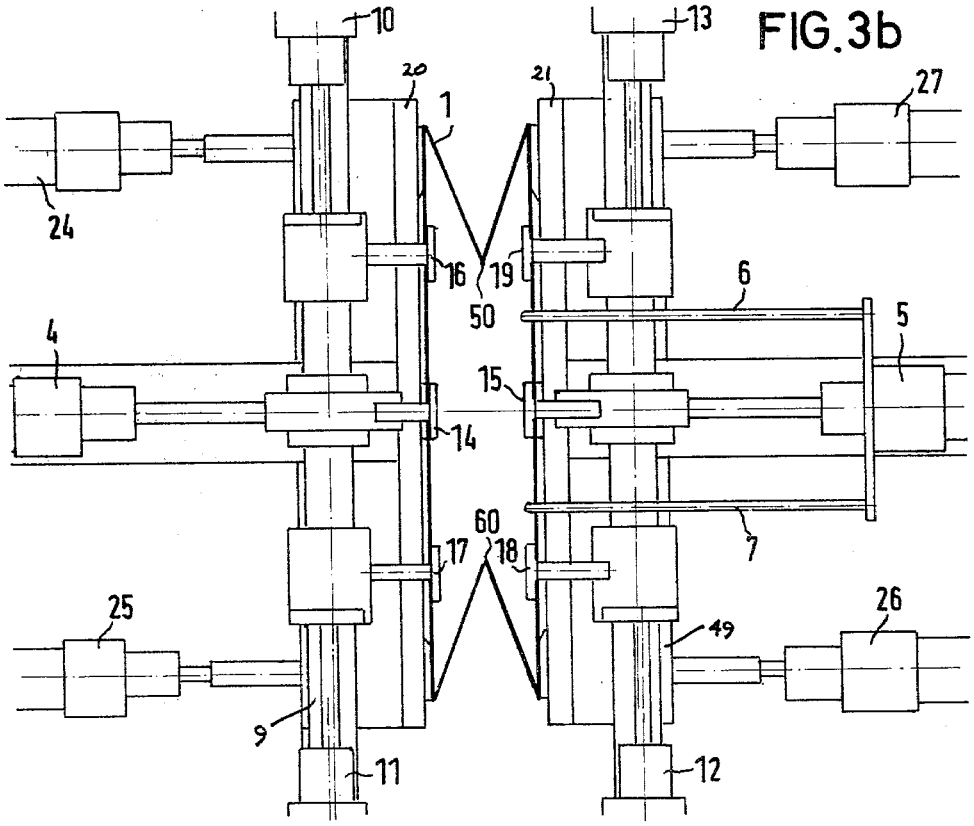

The purposes of the foregoing configuration will become more readily apparent by now returning to FIG. 3. FIG. 3 represents the stage of movement of the several parts, in the sequence which next follows the positioning of parts shown in FIG. 2. In this next stage of the operation, the clamping beams 20 and 21, with the central claws 14, 15 in clamping position on the edges of the bag adjacent its mouth, are drawn apart by means of the transverse cylinders 24–27. As this is occurring, the longitudinal cylinders 10, 11 and 12, 13 move the outer claws 16–19 along their respective ribbed shafts 9, 49 away from the central claws 14, 15 in directions which are generally parallel to the directions of elongation of beams 20, 21. The outer claws 16 and 17 on one side of the bag, and 18 and 19 on the other side of the bag, slide along the interior edges of the bag adjacent its mouth but do not, at this stage of the operation, clamp against the bag edges since the outer claws are spaced from the clamping beam by recesses 42–45. Accordingly, no clamping operation is effected by claws 16–19 until they have moved completely past recesses 42–45 and slide onto converging clamping zones 36, 38, 39 and 41 at the ends of the clamping beams 20, 21. During this transient operation, the position of the central claws 14, 15 on the central clamping zones 37, 40 remains unchanged. Because of the convergence of the outer clamping zones 36, 38, 39, 41 the pleat-sided bag is not stressed during the longitudinal outward movement of the outer claws along their ribbed shafts 9, 49, and a clamping effect is achieved by these outer claws only when they reach their end position, i.e., positions which are respectively in the four corners of the openable mouth of the bag. It will be appreciated that, while the outer claws are moving toward their end positions, their actual paths of movement are diagonal inasmuch as it consists of both a longitudinal movement effected by cylinders 10–13 and a transverse movement effected by cylinders 24–27.

Figure 4A:
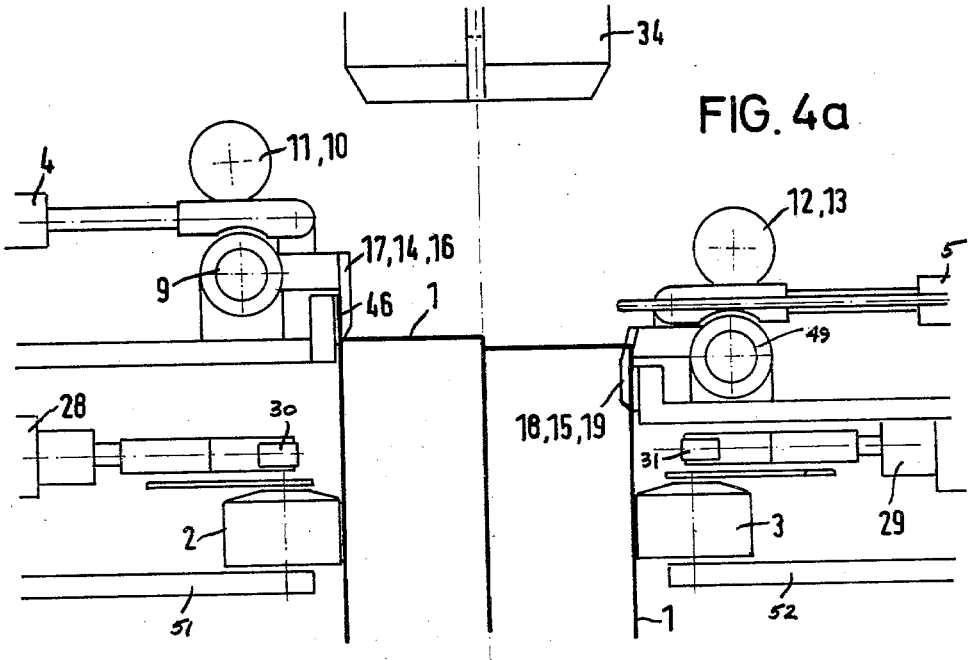
FIGS. 4*a* and 4*b* are still further views of the structure, corresponding to the views described in respect to previous figures, but showing a further stage of the operation wherein the pleated side faces are unfolded to a further extent.
Figure 4B:
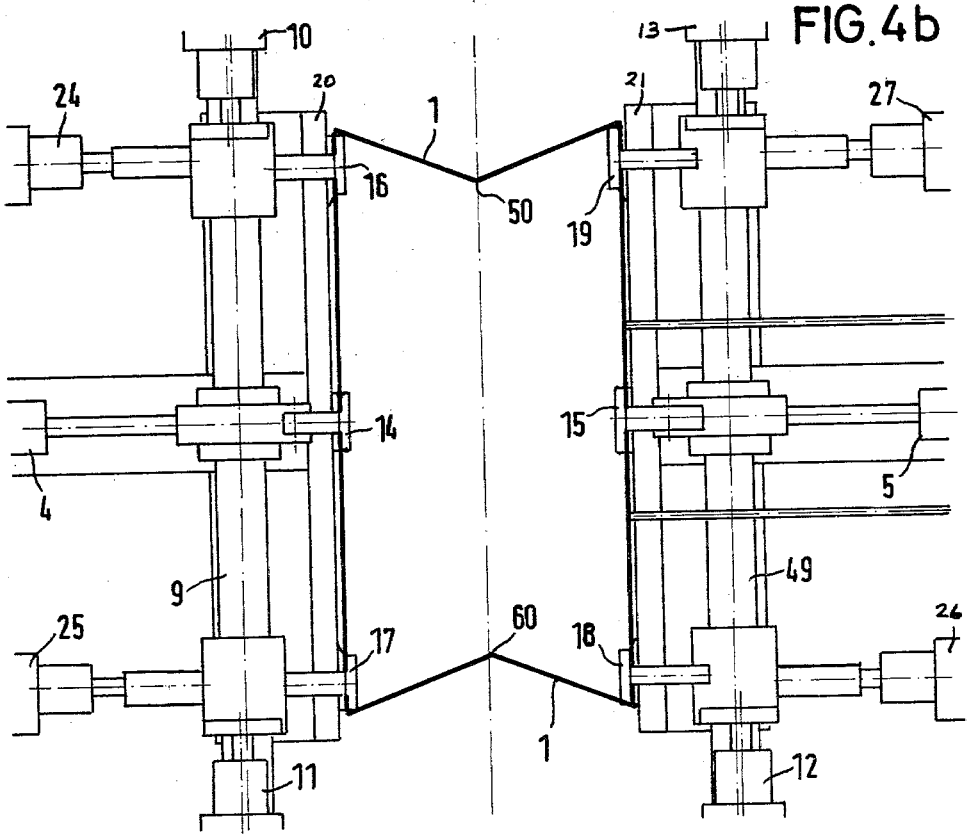

One possible end position for the claws is shown in FIGS. 4*a* and 4*b* and, in this position, the pleated faces of the bag are only partially opened so that the pleats 50 and 60 are not completely stretched. In this position, the outer claws 16–19 are in their outer clamping position, but the clamping beams 20 and 21 and their associated claws have not been moved to their outermost transverse position. It is possible to fill the pleat-edged bag when it reaches the condition shown in FIGS. 4*a* and 4*b*, and this represents, therefore, one embodiment of the present invention.

Figure 4C:
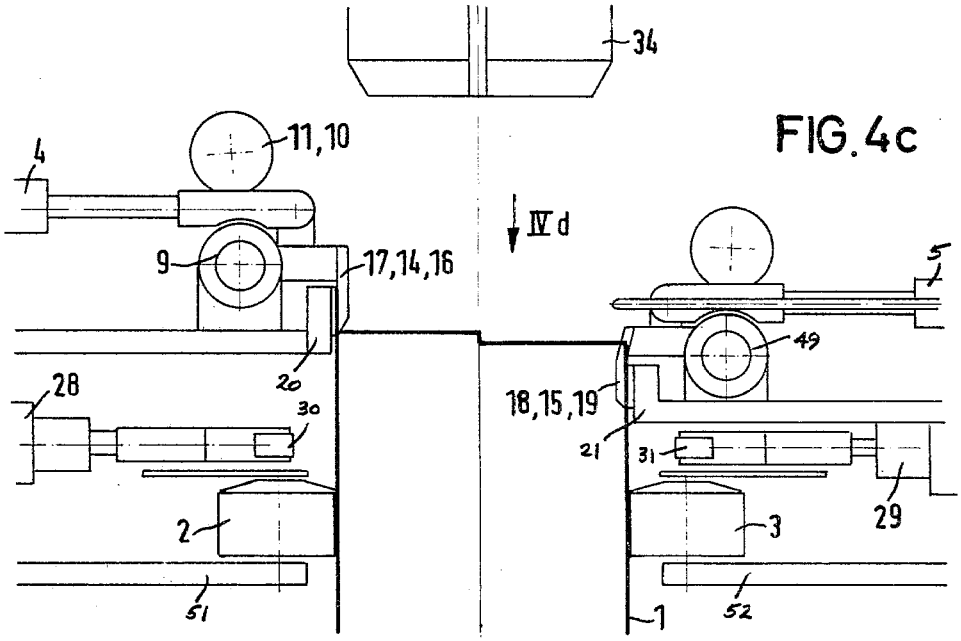
FIGS. 4*c* and 4*d* correspond to FIGS. 4*a* and 4*b* but depict the operation of an alternative embodiment of the invention wherein the pleated side faces of the bag are fully unfolded rather than being less than fully opened as in FIGS. 4*a* and 4*b;*
Figure 4D:
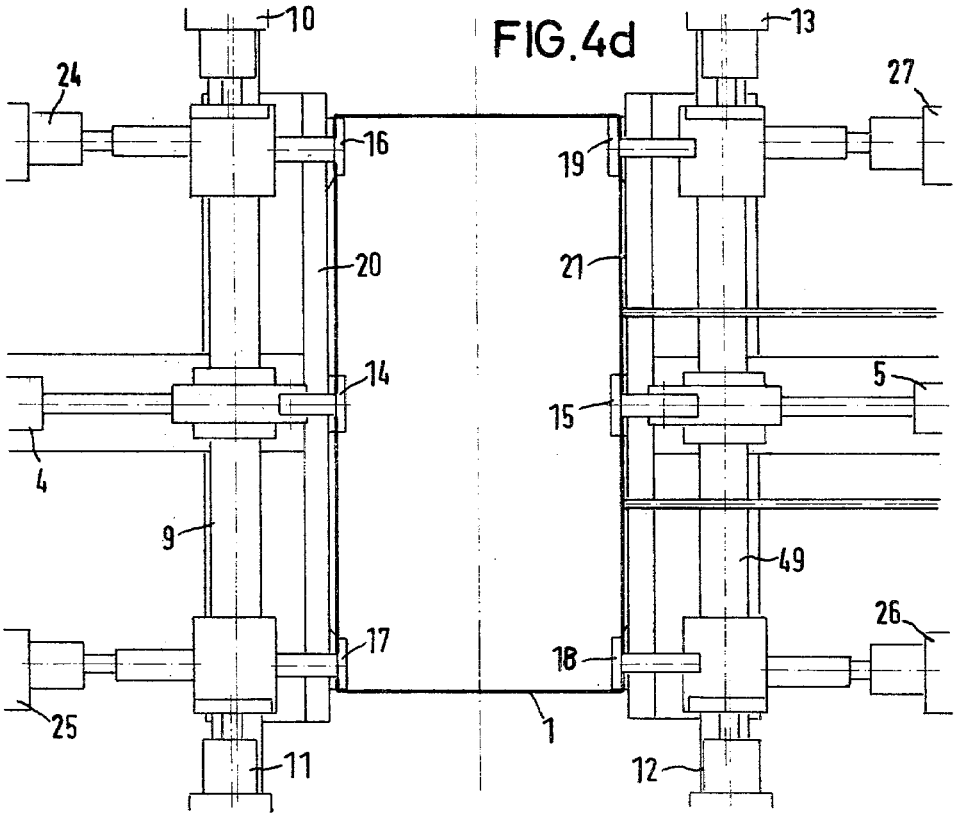

It is equally possible to open the pleat-sided bag completely so that a rectangular fill opening and bag cross section is obtained as can be seen in FIGS. 4*c* and 4*d*. In this second embodiment of the invention, however, reclosure of the pleat-sided bag, after it has been filled, is somewhat more difficult; and in practice, it has been found possible to reclose the bag in this second embodiment of the invention only when special impressing means are provided for pressing the pleated faces of the bag inwardly during the closing operation. This aspect of the invention will be described more fully in reference to FIGS. 6 and 7.

Figure 5A:
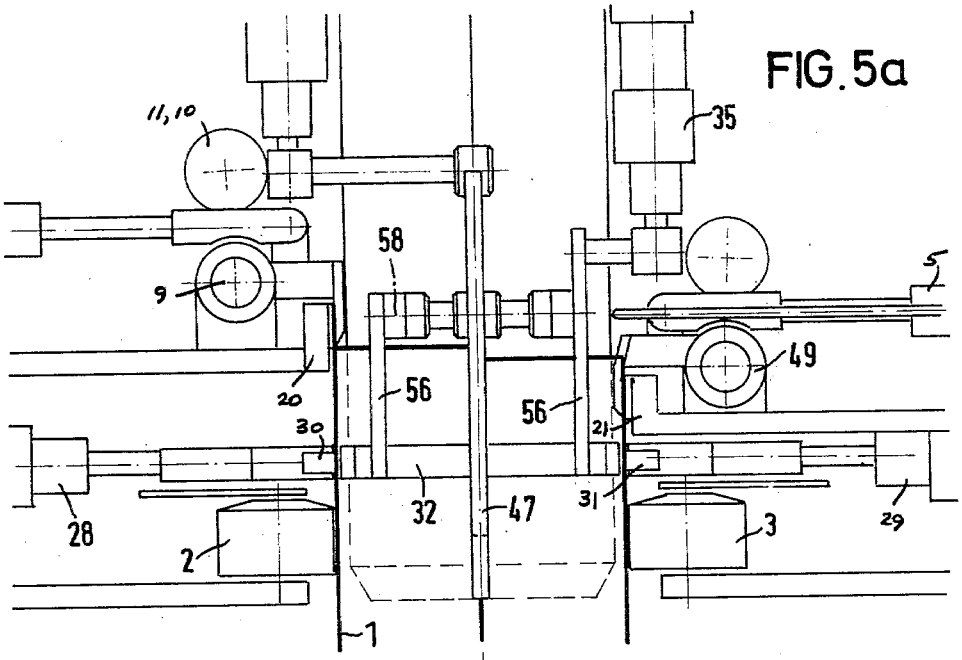
FIGS. 5*a* and 5*b* are side and plan views of the apparatus, with some parts omitted for simplification, illustrating the coaction of a filling funnel with the opened bag and the type of side clamping members which are associated with the partially opened bag embodiment of FIGS. 4*a* and 4*b;*
Figure 5B:
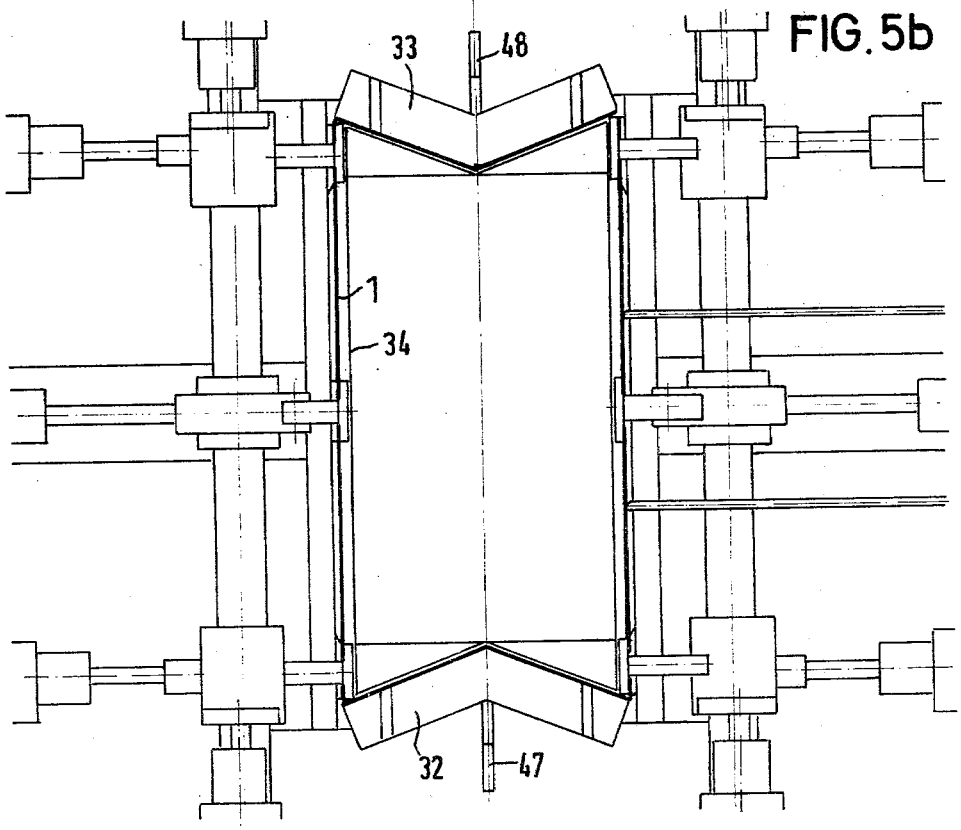
Figure 5C:
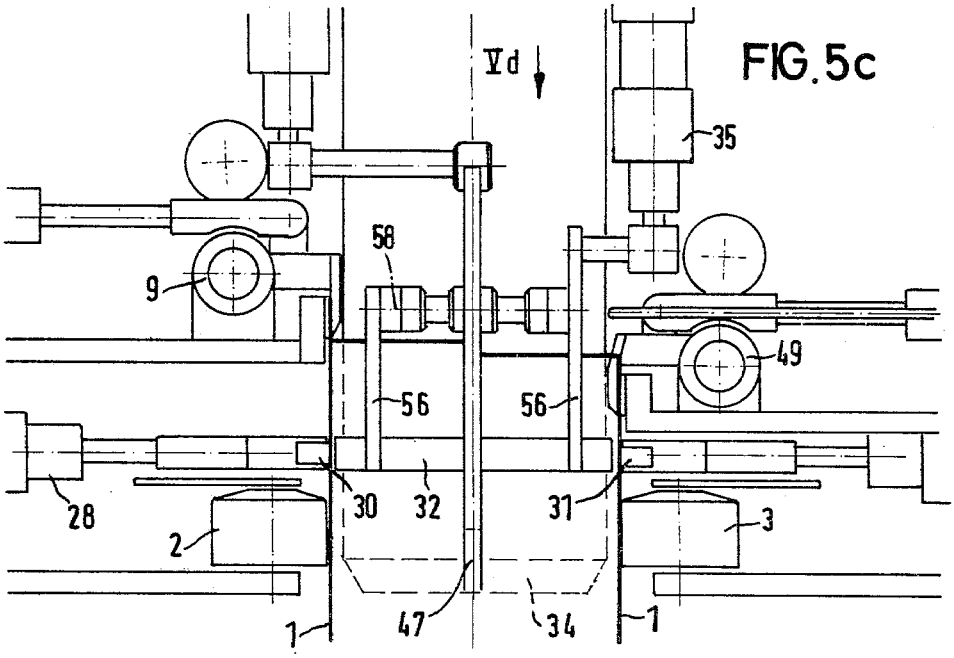
FIGS. 5*c* and 5*d* are views similar to FIGS. 5*a* and 5*b,* but depict the use of a filling funnel and the configuration of the side clamping elements which are employed when the bag is completely opened in accordance with the embodiment of FIGS. 4*c* and 4*d;*
Figure 5D:
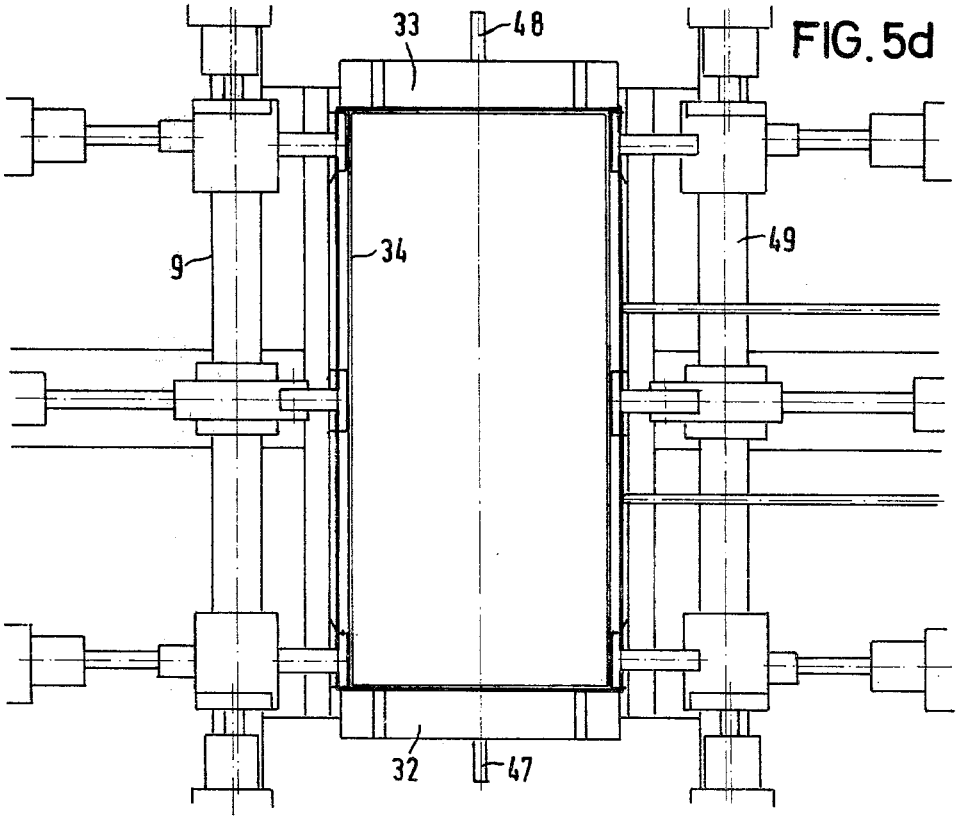

While the bag is being opened, the filling funnel 34 is disposed adjacent to the mouth of the bag, but outside of the bag as shown in FIGS. 1–4. After the bag has been opened, however, and is ready for filling, the filling funnel is inserted into the bag as shown in FIG. 5. The filling mechanism shown in FIGS. 5*a* and 5*b* represents the type of mechanism which would be employed when the bag opening mechanism achieves the end position shown in FIGS. 4*a* and 4*b;* and the corresponding structure which is shown in FIGS. 5*c* and 5*d* represents the type of structure which would be employed when the bag has been fully opened pursuant to FIGS. 4*c* and 4*d*. In each case, the external shape of the funnel is so chosen that its cross section corresponds essentially to the shape of the opening in the bag when the bag has been opened to its end position, and pressure bars are provided for engaging the exterior of the bag along its partially or fully unfolded pleated faces to clamp said pleated faces against complementarily shaped portions of the filling funnel that has been inserted into the bag. In each of these instances, the sealing bars 32, 33 cooperate with further clamping members 30, 31 (compare FIG. 5 with the preceding figures) which are moved into engagement with the unpleated front and rear faces of the bag by means of cylinders 28, 29 to clamp the said unpleated faces of the bag against the inserted funnel at the same time that the pleated faces of the bag are being clamped against the other sides of the funnel by means of sealing bars 32, 33.

In the embodiment of FIGS. 4*a* and 4*b*, the sealing bars 32, 33 are of V-shaped cross section as shown in FIG. 5*b*, to conform to the partially unfolded shape of the pleated side faces of the bag in this particular embodiment. Where the embodiment is such, however, that the pleated side faces of the bag have been opened completely, as shown in FIGS. 4*c* and 4*d*, the sealing bars 32, 33 associated with the pleated faces of the bag assume the rectangular configuration illustrated in FIG. 5*d*. The filling funnel which is employed in these two embodiments of the invention must be configured in accordance with similar considerations, i.e., when the filling funnel is to be employed in filling a bag that has been opened to the extent shown in FIG. 5*b*, the filling funnel is provided with V-shaped indents at its lower end; but when the filling funnel is used to fill a bag which has been opened to its fullest extent as shown in FIG. 5*d*, the cross-sectional shape of the funnel is rectangular.

After the pleat-sided bag has been opened, the filling funnel 34 is inserted into the bag opening or mouth and allows material to flow into the bag. In order to prevent escape of material and to achieve a dust-free filling operation, the aforementioned longitudinal sealing bars 30 and 31, and the previously mentioned transverse sealing bars 32 and 33, are moved into position to engage each of the exterior faces of the pleat-sided bag, to press the bag sides against the longitudinal side walls of the funnel 34. As mentioned previously, movement of the longitudinal sealing bars 30, 31 is effected by sealing bar cylinders 28, 29. The sealing bars 32, 33, which cooperate with the short sides or pleated faces of the bags, are operated by means of a further cylinder 35, as shown in FIGS. 6 and 7.

Figure 6B:
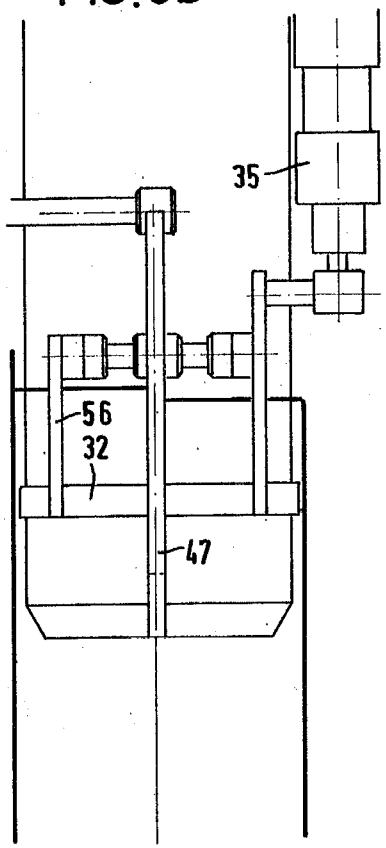
FIG. 6*b* is a further view of the structure of FIG. 6*a* taken in the direction of arrow VIb of FIG. 6*a;*
Figure 6A:
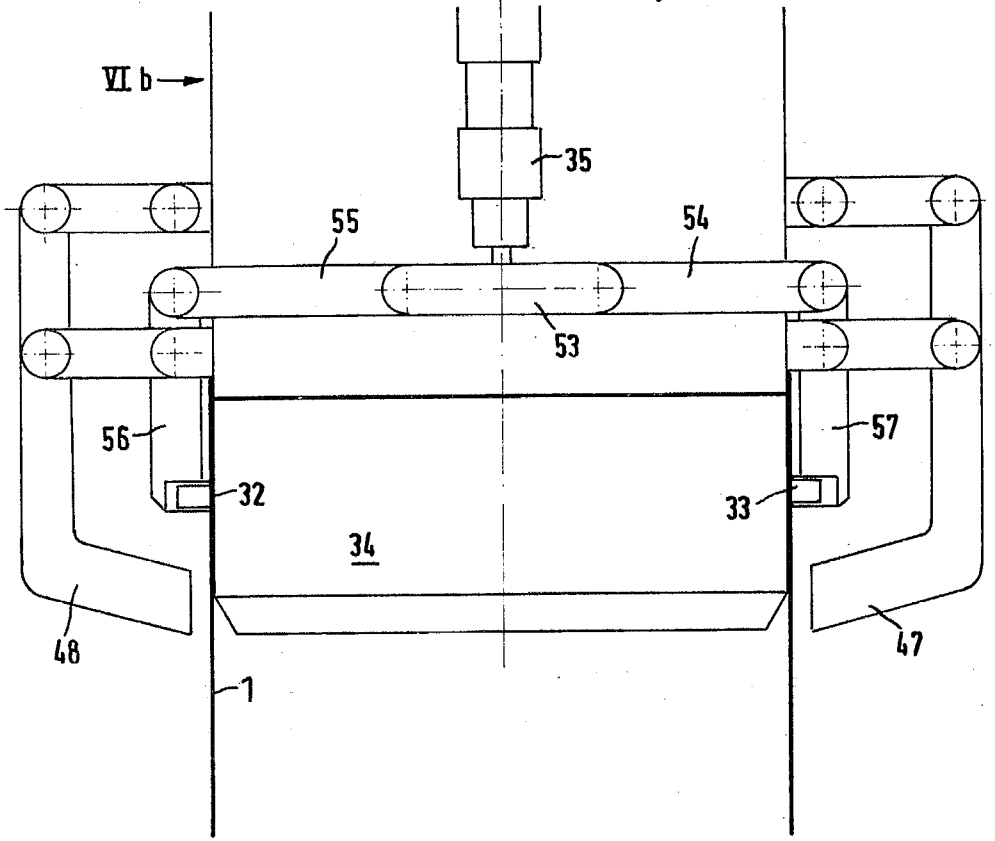
FIG. 6*a* is a detail side view of a sealing and folding mechanism which is situated on and cooperates with the filling funnel.
Figure 7B:
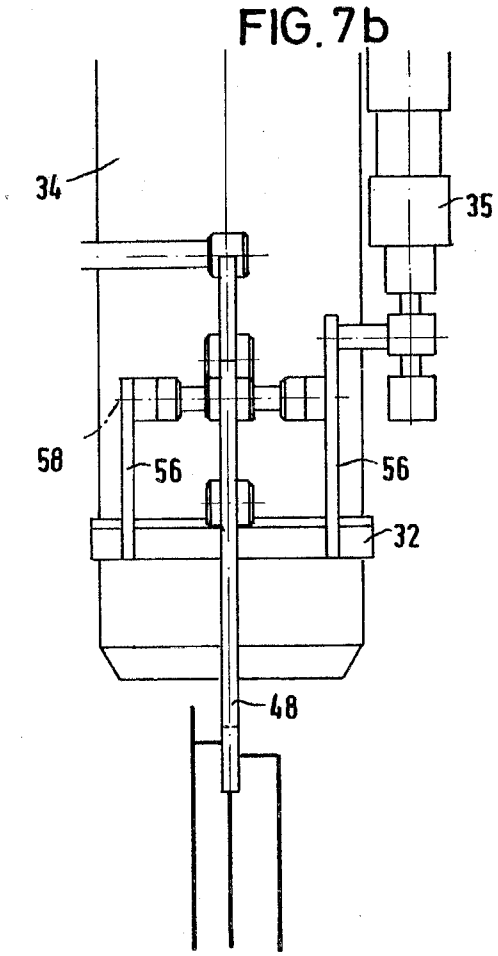
FIGS. 7*a* and 7*b* are further views of the structures shown in FIGS. 6*a* and 6*b* respectively, showing the operation of the sealing and folding means as the filling funnel is removed from the filled bag.
Figure 7A:
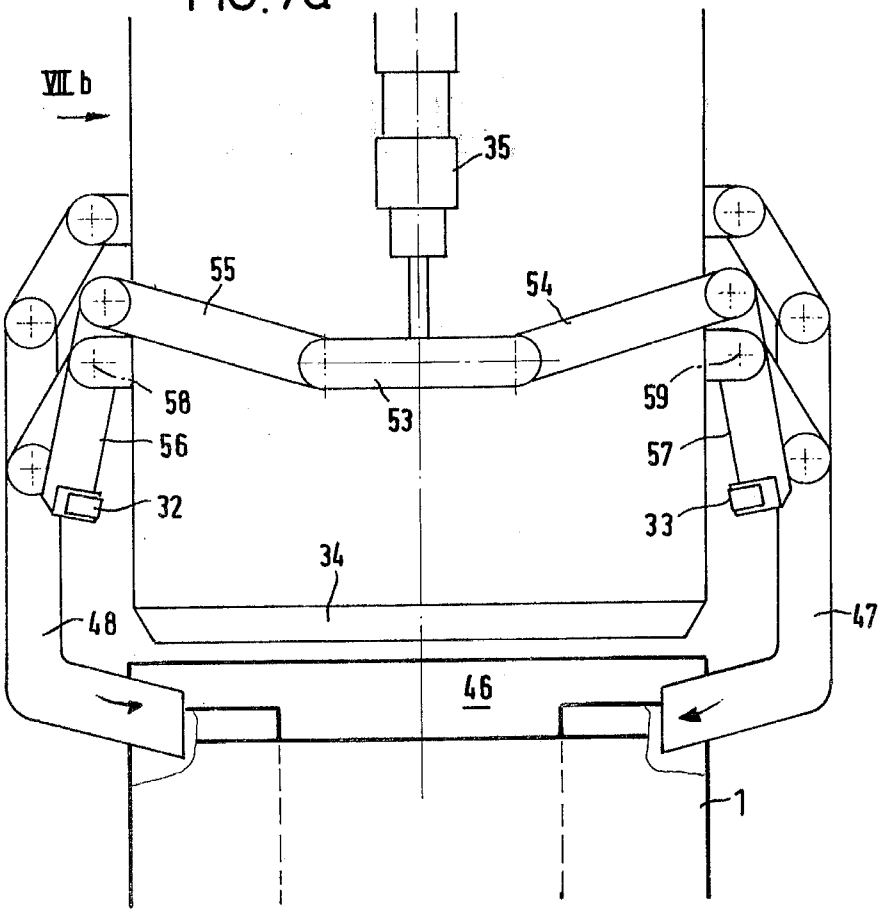

Referring initially to FIGS. 6*a* and 6*b*, as the funnel 34 is moved into the bag 1 the cylinder 35, operating through a linkage, pivots sealing bars 32 and 33. The cylinder 35 transfers its movement through a lever 53 on the piston rod to two intermediate levers 54 and 55 which are in turn connected to end levers 56, 57 that carry the transverse sealing bars 32, 33 at their lower ends. After the pleat-sided bag has been filled, and subsequent to the removal of the sealing bars 32, 33 from their operative position, the funnel 34 is withdrawn upwardly from and out of the mouth of the bag. The sealing bars 32 and 33 then assume the position shown in FIG. 7, in which the end levers 56, 57 have been pivoted about the fixed horizontal axes 58, 59. It will be appreciated that, inasmuch as the mechanism shown in FIG. 6 and 7 is carried by the filling funnel, the sealing bars 32, 33 move upwardly and downwardly along the pleated sides of the bag with corresponding movement of the funnel 34 into and out of the bag.

Two impressing members 47, 48, also known as daggers, are provided as a part of the mechanism and are disposed adjacent the pleated sides of the bag to press the pleats 50 and 51 inwardly so that, when the clamping beams 20 and 21 subsequently close together, the pleats 50 and 51 cannot fold outwards. The impressing members 47, 48 are moved by a linkage of the type shown in FIGS. 6 and 7, with this movement being accomplished by a common driving means (not shown).

After the foregoing motions have been accomplished, the upper end of the filled bag is pushed together until the inside edges of the mouth of the bag opening on each side thereof meet. This occurs when the base plates 22, 23 and the plates 51, 52 with the clamping beams 20, 21 thereon close in together. Subsequently, the claws are withdrawn and the filled bag is transported horizontally out of the filling station. The sealing flap 46 is then folded over and secured at a position outside of the filling station.

The operation of the various cylinders, at proper times and in proper sequence, can be controlled by an appropriate control mechanism (not shown). A variety of such control mechanisms can be provided by those skilled in the art, based upon the sequence of operations which have been described herein.

While I have thus described preferred embodiments of the present invention, it must be understood that the foregoing description is intended to be illustrative only and not limitative of the present invention. All such variations and modifications as are in accord with the principles described are meant to fall within the scope of the appended claims.

Having thus described my invention I claim:

1. A filling station for filling pleat-sided bags, comprising means for transporting a bag in flat form to a filling position, said bag being of the type having a closed bottom, unpleated front and rear faces and pleated side faces joined thereto to define an openable mouth opposite to said bottom, a pair of elongated clamping beams extending across the exteriors of the nonpleated front and rear faces of the bag in directions substantially parallel to said nonpleated faces when said bag is in said filling position, a plurality of spreading members disposed adjacent each of the opposing nonpleated front and rear faces of said bag when said bag is in said filling position, said spreading members having claws movably mounted thereon and adapted to engage the opposing interior edges of said bag along the nonpleated faces of said bag adjacent to its said openable mouth, means for moving at least some of the claws on each side of said bag away from one another along paths substantially parallel to the directions of elongation of said clamping beams thereby to clamp the edges of said bag adjacent its openable mouth between said claws and said clamping beams at a plurality of spaced locations along the unpleated rear and front faces of the bag, means for moving the spreading members together with their associated clamping beams on opposite sides of said bag away from one another in directions transverse to the planes of the front and rear faces of the bag thereby to at least partially unfold the pleated side faces of said bag while opening the mouth of said bag, a filling funnel outside of said bag adjacent its said mouth for filling said bag via the mouth of said bag, means for moving said funnel into the opened mouth of said bag, further clamping means disposed adjacent the exterior of said bag, and means for moving said further clamping means into engagement with the exterior of said bag to clamp the faces of said bag to said filling funnel during the filling of said bag.

2. The filling station of claim 1 wherein said claws are vertically displaced from one another adjacent the nonpleated front and rear faces of said bag respectively.

3. The filling station of claim 1 wherein said means for moving said spreading members are hydraulically operated.

4. The filling station of claim 1 wherein said means for moving said spreading members are pneumatically operated.

5. The filling station of claim 1 wherein three of said claws are disposed adjacent each of the opposing nonpleated front and rear faces of said bag, the central one of said three claws being adapted to clamp an associated edge of said bag to an associated one of said clamping beams at a substantially central location along one of said front and rear bag faces, and the other two of said three claws being mounted for movement in opposing directions respectively away from said central claw to clamp an associated edge of said bag to an associated one of said clamping beams at a pair of further locations which are disposed respectively adjacent the corners of said bag.

6. The filling station of claim 1 wherein said elongated clamping beams are provided with a plurality of protruding clamping zones adapted to be engaged respectively by different ones of the claws on said spreading members, said clamping zones being spaced from one another by intervening recesses on said clamping beams.

7. The filling station of claim 6 wherein each of said clamping beams is provided with a substantially centrally located clamping zone and with a pair of further clamping zones which are spaced from and disposed on opposite sides of said central clamping zone, said central clamping zone and the face of the claw with which it cooperates being oriented in a direction substantially parallel to the direction of elongation of said clamping beam, and said further clamping zones and the faces of the claws with which they cooperate being oriented at an acute angle relative to the direction of elongation of said clamping beam.

8. The filling station of claim 1 wherein said bag is of the type having one unpleated face that is longer than the other unpleated face of said bag to define a flat-faced sealing flap for said bag, said filling station including retaining means adapted to be moved into engagement with the flat face of said sealing flap prior to the movement of said claws into their bag engagement positions.

9. The filling station of claim 5 wherein said means for moving said other two of said spreading members is operable to effect a diagonal motion of each of said other two spreading members consisting of a combined longitudinal and transverse movement thereof.

10. The filling station of claim 5 wherein said means for moving said claws is operable to move the central ones of said claws into clamping engagement with said interior edges of said bag prior to movement of the other two of said claws into clamping engagement with said bag edges.

11. The filling station of claim 1 wherein said further clamping means comprises a first pair of flat-faced clamping elements which are positioned to engage the nonpleated flat faces of the bag respectively and a second pair of clamping elements which are positioned to engage the unfolded pleated side faces of the bag respectively, and means for moving said clamping elements toward and away from their associated bag faces.

12. The filling station of claim 11 wherein said second clamping elements are mounted for movement with said filling nozzle toward and away from said bag, whereby said second clamping elements are operative to move upwardly and downwardly along the pleated side faces of said bag as well as toward and away from said pleated side faces.

13. The filling station of claim 1 including means for pressing the unfolded pleated side faces of said bag inwardly after said bag has been filled.

* * * * *